US005524844A

United States Patent [19]

McCormick et al.

[11] Patent Number: 5,524,844

[45] Date of Patent: Jun. 11, 1996

[54] APPARATUS FOR PREPARING A LEADING EDGE OF WEB MATERIAL

[75] Inventors: Michael O. McCormick, Loves Park; Chester W. Moore, Roscoe, both of Ill.; Daniel R. Hicks, Beloit, Wis.; Gower W. Koebler, Rockton, Ill.

[73] Assignee: Enkel Corporation, Rockford, Ill.

[21] Appl. No.: 146,888

[22] Filed: Oct. 29, 1993

[51] Int. Cl.[6] ..... B65H 19/10; B65H 23/04

[52] U.S. Cl. ..... 242/562; 242/553; 242/910

[58] Field of Search ..... 242/562, 562.1, 242/547, 553, 442.5, 910, 556.1, 554.2

[56] References Cited

U.S. PATENT DOCUMENTS

| | | | |
|---|---|---|---|
| 2,346,756 | 4/1944 | Hoppe | 242/422.5 X |
| 2,880,778 | 4/1959 | Spangler | 242/562 X |
| 3,010,672 | 11/1961 | Cecil, Jr. | 242/562 X |
| 3,066,723 | 12/1962 | Remington et al. . | |
| 3,315,592 | 4/1967 | Lems | 242/910 X |
| 3,329,083 | 7/1967 | Bellmann | 242/910 X |
| 3,406,084 | 10/1968 | Varga . | |
| 3,417,688 | 12/1968 | Shakely | 242/910 X |
| 3,602,448 | 8/1971 | Muensterer | 242/547 X |
| 3,630,346 | 12/1971 | Burnside | 206/56 |
| 3,765,992 | 10/1973 | Stageberg | 156/521 |
| 3,834,204 | 9/1974 | Ihle | 242/562 X |
| 3,899,142 | 8/1975 | Hodges, Jr. et al. | 242/910 X |
| 4,177,959 | 12/1979 | Lancaster et al. . | |
| 4,351,687 | 9/1982 | Lesage | 242/562 X |
| 4,398,379 | 3/1981 | Burford | 53/77 |
| 4,459,170 | 6/1981 | Kerwin | 156/361 |
| 4,555,288 | 11/1985 | Nozaka | 156/191 |
| 4,597,820 | 7/1986 | Nozaka | 156/353 |
| 4,636,276 | 1/1987 | Nozaka | 156/353 |
| 4,840,320 | 6/1989 | Shigeta et al. | 242/562.1 X |
| 4,861,411 | 8/1989 | Tezuka | 156/344 |
| 4,905,924 | 3/1990 | Moore . | |
| 4,980,011 | 12/1990 | Gruber et al. | 156/361 |
| 4,995,406 | 2/1991 | da Silva | 242/562 X |
| 5,076,878 | 12/1991 | McLees et al. | 156/353 |
| 5,212,002 | 5/1993 | Madrzak et al. | 428/40 |

FOREIGN PATENT DOCUMENTS

| | | |
|---|---|---|
| 2025473 | 5/1991 | Canada . |
| 2069247 | 12/1992 | Canada . |
| 2025376 | 1/1980 | United Kingdom . |

*Primary Examiner*—John M. Jillions
*Attorney, Agent, or Firm*—Kinney & Lange

[57] ABSTRACT

An apparatus for tensioning an outer layer or web material about a roll of web material includes a tension roller assembly. The tension roller assembly is defined by a rotatable idler roller that is movable into and out of contact with the outer layer of web material by way of a linear drive mechanism. Idler roller contact with the web material outer layer tensions the outer layer about the roll of web material. A tensioner associated with the idler roller adjusts the rotational drag on the idler roller which controls the amount of tension that the idler roller applies to the web material outer layer. A vacuum retraction assembly of the tensioning apparatus acts to further tension the web material outer layer. The vacuum retraction assembly includes a vacuum bar having a plurality of vacuum cups coupled to a vacuum source. The vacuum bar is movable relative to the roll of web material by way of a drive mechanism such that actuation of the vacuum source causes the outer layer of web material to adhere to the vacuum bar while subsequent movement of the vacuum bar away from the roll of web material acts to further tension the outer layer of web material about the roll of web material.

17 Claims, 8 Drawing Sheets

APPARATUS FOR PREPARING A LEADING EDGE OF WEB MATERIAL

BACKGROUND OF THE INVENTION

The present invention relates generally to an apparatus and method for preparing a leading edge of a roll of web material. In particular, the present invention is an apparatus and method for tensioning web material of a roll of web material for the formation of a cut leading edge and the subsequent application of flying splice adhesive tape to the cut leading edge of the roll of web material.

In the newspaper and magazine publishing industry, the lengths of web material (i.e., paper), from which individual newspapers or magazines are printed, are contained on rolls (i.e., elongate members). Typically, the length of web material or a roll is fixed, and the web material is continuous from its trailing edge at the core or the roll to its leading edge at the periphery or the roll. The length or web material from an individual roll is fed into a printing apparatus where print and/of pictures are applied to the web material in a continuous automated process. Next, the length of web material is cut into sheets of desired size and then these sheets are assembled into individual newspapers of magazines. The cutting of the sheets and the assembling of the sheets into their final print medium format is once again, a continuous, automated process. Typically, during the continuous process of printing, cutting and assembling or the print medium, the length of web material travels at speeds of between 2000 and 3000 feet per minute. Hence, large numbers of individual newspapers or magazines can be produced in a relatively short period of time.

A disadvantage in the use of the rolls of web material occurs when splicing a leading edge of a "new" roll of web material to the trailing edge of an "old" roll of web material currently traveling through the continuous printing, cutting and assembling process. This type of new-to-old roll connection is referred to as a "flying splice", and is a splice made between an expiring or leading roll of web material and a new of following roll of web material in a continuous manner without reducing either the equipment speed or the speed of the web. Typically, to splice the leading edge of the new roll to the trailing edge of the old roll, the web material of the roll of web material is first manually trimmed to form a cut leading edge of web material. Subsequent to the formation of the cut leading edge, one or more pieces of adhesive tape are manually applied to the cut leading edge of the new roll of web material. Adhesive, such as pressure sensitive adhesive, on a bottom surface of the tape secures the tape to the leading edge. With the tape secured to the leading edge of the new roll the leading edge of the new roll is brought into contact with the old roll, where adhesive, such as pressure sensitive adhesive, on the top surface of the tape secures the leading edge of the new roll of web material to the trailing edge of the old roll of web material. Once the splicing process is complete, movement of the web material of the old roll, through the apparatus performing the printing, cutting and assembling process, acts to continuously and automatically thread the web material of the new roll into the printing, cutting and assembling apparatus. Due to the complex and mostly manual nature of timing the cut leading edge of web material and for applying flying splice adhesive tape to the cut leading edge of a roll of web material, the process is tedious, cumbersome and time consuming. Operator time to manually prepare the cut leading edge and apply a flying splice preparation pattern to the cut leading edge of web material may range from about 4–8 minutes for small rolls and/or 5–15 minutes for large rolls depending on press speed and operator efficiency.

In addition, the hand work required by one or more people to manually from the cut leading edge and apply a piece or pieces of flying splice adhesive tape to the cut leading edge of web material is not condusive to the accurate formation of the cut leading edge or the accurate positioning of the tape on the cut leading edge of the web material. In particular, the use of manual techniques to form the cut leading edge may result in a cut leading edge of undesired or misformed shape (e.g., a waveform leading edge when a straight leading edge is desired) which may affect subsequent positioning of the adhesive tape and tape separation during the "flying splice" process. Moreover, adhesive (particularly pressure sensitive adhesive) on the top and bottom surfaces of the flying splice adhesive tape tends to adhere to the leading edge of the web material virtually on contact, making repositioning of the tape difficult, and thereby further complicating the process of accurately aligning the tape on the leading edge of the web material. In accurate formation of the cut leading edge and subsequent misalignment of the flying splice adhesive tape on the cut leading edge of the web material may result in the leading edge of the new roll being incorrectly applied to the trailing edge of the old roll, which may cause the new web of material to be improperly threaded into the apparatus performing the printing, cutting and assembling process. Incorrect feeding of the new web material into the apparatus may cause the apparatus to seize resulting in machine down time and lost production time.

Apparatus for forming a cut leading edge and for applying flying splice adhesive tape to the cut leading edge of a roll of web material are generally known. Canadian patent application 2,069,247 to Norbert et al. discloses one such apparatus for preparing a leading edge of a new roll of web material for a flying splice. The apparatus of Norbert et al. includes a base plate for carrying a knife support block that extends substantially parallel to the axis of rotation of the roll of web material. A cutting knife of the cutting block forms the cut leading edge of the roll of web material while a perforating blade forms a perforated region in the web material spaced from the leading edge. The cutting knife and perforating blade are parallel to one another and to the axis of rotation of the web material roll. The base plate further carries an adhesive application block for holding adhesive. The adhesive application block applies a first adhesive to a lower surface of the web material between the leading edge of the web material and the web material cuts made by the perforating blade. A connecting adhesive application roller applies a second adhesive to an upper surface of the web material adjacent the web material cuts made by the perforating blade but oil a side of the cuts opposite to the first adhesive. The first adhesive secures the leading edge of web material to the next underlying layer of web material on the roll of web material. The second adhesive contacts and secures the leading edge of new roll web material to a trailing edge of an expiring roll of web material and web material separation occurs along the cuts made by the perforating blade.

In operation, web material is rolled off of the roll to bring the web material into position on the splice preparation apparatus of Norbert et al. The leading edge and perforations are cut and the first and second adhesives are applied to the web material. The web material is then rewound onto the roll and the leading edge of web material is secured to the next underlying layer of web material on the roll of web material via the first adhesive. Unwinding the web material off of the roll to position the web material on the cutting block may result in slack areas or wrinkled areas of web material. These wrinkled and or slack areas of web material may cause the formation of a cut leading edge of undesired or misformed shape (i.e., a waveform leading edge when a straight leading edge is desired). In addition, unwinding and rewinding the web material off and on the roll and a misformed cut leading edge may cause web material wrinkles and web material misalignment due to inadvertent and misaligned adhesion of the first adhesive to the underlying layer of web material.

There is a need for an apparatus and a method for forming a desired accurate cut leading edge for subsequent application of flying splice adhesive tape to the cut leading edge of a roll of web material. Specifically, the application apparatus should substantially eliminate web material slack and wrinkles to permit the accurate formation of a cut leading edge of web material of desired shape, so that the tape can be applied to the cut leading edge of the web material quickly and with alignment accuracy when compared to prior manual and automatic procedures for forming cut leading edges for the subsequent application of flying splice adhesive tape. In addition, the method for eliminating web material slack and wrinkles should not be hand work intensive, cumbersome or tedious.

SUMMARY OF THE INVENTION

The present invention is all apparatus and method for tensioning an outer layer of web material of a roll of web material. The tensioning apparatus includes a carrier frame assembly mounted on a main frame. The carrier frame assembly is configured to be positioned adjacent to a roll of web material and includes a tensioning assembly for contacting all outer layer of web material of the roll of web material and for applying tension to the outer layer of web material.

The tensioning assembly is defined by a tension roller assembly that includes a rotatable idler roller and a drive mechanism mounted on the carrier frame assembly. The drive mechanism is configured to move the idler roller between all initial position wherein the idler roller is spaced from the outer layer of web material toward a final position wherein the idler roller contacts the outer layer of web material and acts to tension the outer layer about the roll of web material. A tensioner associated with the idler roller adjusts the rotational drag on the idler roller which controls the amount of tension that the idler roller applies to the web material outer layer.

A vacuum retraction assembly of the tensioning assembly acts to further tension the web material outer layer. The vacuum retraction assembly includes a vacuum bar having a plurality of vacuum cups coupled to a vacuum source. The vacuum bar is movable relative to the roll of web material by way of a drive mechanism such that actuation of the vacuum source causes the outer layer of web material to adhere to the vacuum bar while subsequent movement of the vacuum bar away from the roll of web material acts to further tension the outer layer of web material about the roll of web material.

This tensioning apparatus and method provides an automated means for tensioning an outer layer of a roll of web material to substantially eliminate web material slack and wrinkles to permit the accurate formation of a cut leading edge of web material of desired shape and consistency from one cut to the next. This allows splicing tape to be applied to the cut leading edge of web material quickly and with alignment accuracy.

BRIEF DESCRIPTION OF THE DRAWINGS

The invention is further described with reference to the accompanying drawings, where like numbers refer to like parts in several views.

These drawing figures are provided tier illustrative purposes only and are not drawn to scale, nor should they be construed to limit the intended scope and purpose of the present invention.

DETAILED DESCRIPTION OF THE PREFERRED EMBODIMENTS

Figure 1:
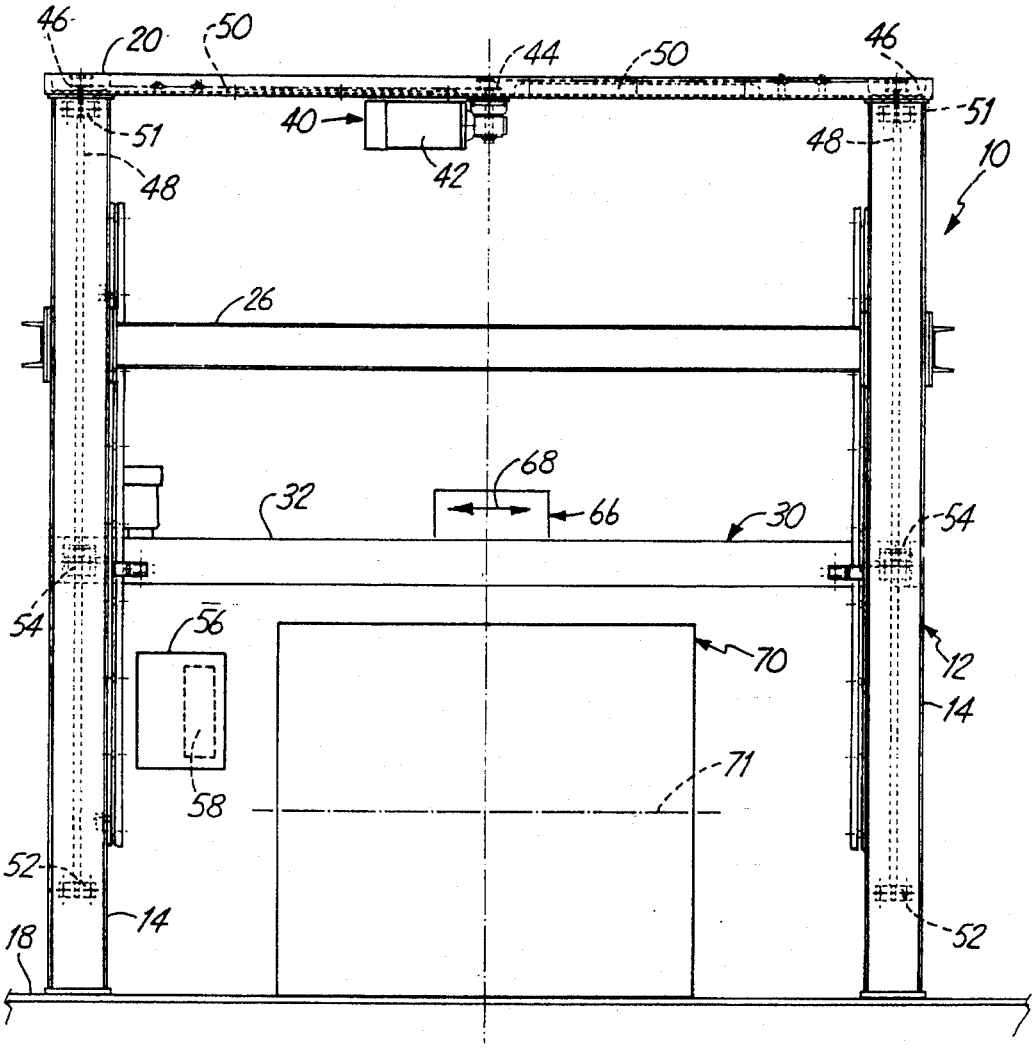
FIG. 1 is a front elevational view of a web material tensioning apparatus in accordance with the present invention with a tension roller assembly and vacuum retraction assembly removed for clarity and a web cutting and tape application apparatus shown in a block schematic.
Figure 2:
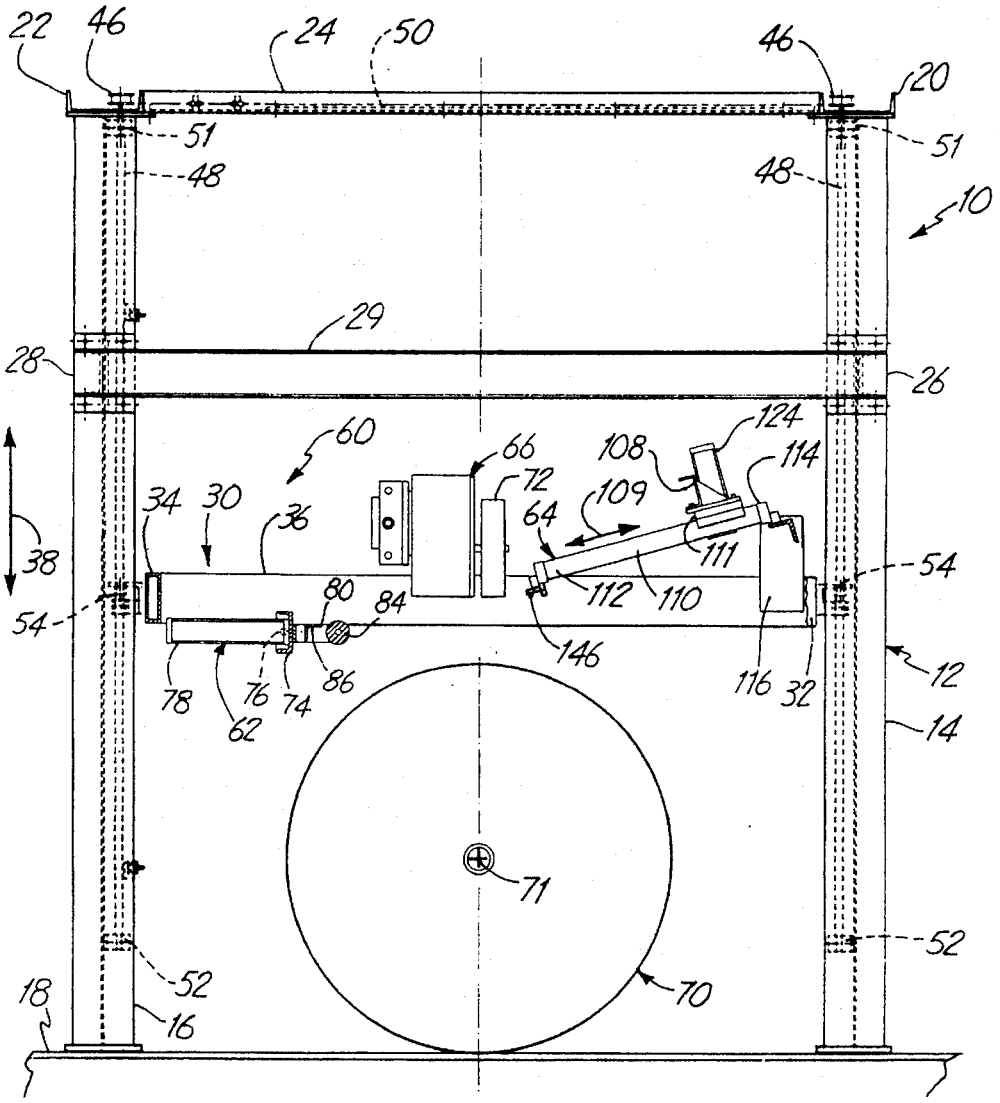
FIG. 2 is an end elevational view similar to FIG. 1 of the web material tensioning apparatus including the tension roller assembly and vacuum retraction assembly with the web cutting and tape application apparatus shown in greater detail.

A web material tensioning apparatus 10 in accordance with the present invention is illustrated generally in FIGS. 1 and 2. The tensioning apparatus 10 includes a main frame 12 defined by a pair of spaced, upright front posts 14 and a pair of spaced, upright rear posts 16 (only one of which can be seen in FIG. 2). The front and rear posts 14 and 16 are supported on a floor surface 18. Front posts 14 are coupled together at their upper ends by a front cross member 20 while rear posts 16 are coupled together at their upper ends by a rear cross member 22. End cross members 24 (only one of which can be seen in FIG. 2) couple upper ends of adjacent front and rear posts 14 and 16. An intermediate front connecting member 26, an intermediate rear connecting member 28 and end connecting members 29 further join front and rear posts 14 and 16 and act to further rigidify main frame 12 (only one of which can be seen in FIG. 2). The main frame 12 supports a movable carrier frame 30 defined by a front support member 32, a rear support member 34 and end support members 36 (forming a rigid structure as seen in FIG. 2).

The carrier frame 30 is linearly movable relative to the main frame 12 in opposite directions (as represented by double headed arrow 38 in FIGS. 1 and 2). via a main frame drive assembly 40. The drive assembly 40 includes an electric drive motor 42 supported by the front cross member 20 of the main frame 12. A drive sprocket 44 on an output shaft of the drive motor 42 is coupled to driven sprockets 46 of threaded drive rods 48 via a plurality of drive chains 50. Upper and lower ends of the threaded drive rods 48 are supported for rotational movement within the front and rear posts 14 and 16 via upper and lower bearing elements 51 and 52, respectively. Threaded drive nuts 54 mounted on the carrier frame 30 cooperate with the drive rods 48, such that upon operation of the drive motor 42 the drive rods 48 rotate in unison (via drive sprocket 44, drive chains 50, driven sprockets 46), thereby linearly driving the drive nuts 54 in the direction of double headed arrow 38 to raise and lower carrier frame 30 relative to main frame 12. The drive motor 42 is coupled to an operator control panel 56 which houses a microprocessor 58 which controls the operation of the drive motor 42 and thereby the positioning of the carrier frame 30 relative to the main frame 12.

As seen best in FIG. 2, the carrier frame 30 supports a web material tensioning apparatus 60 defined by a tension roller assembly 62 and a vacuum retraction assembly 64. In addition, the carrier frame 30 further supports a web cutting and tape application apparatus 66 that is linearly movable relative to the carrier frame 30 in opposite directions (as represented by double headed arrow 68 in FIG. 1). The carrier frame 30 is movable relative to the main frame 12 so as to position the web material tensioning apparatus 60 and the web cutting and tape application apparatus 66 adjacent to a roll of web material 70 positioned within the confines of the main frame 12. The roll of web material 70 is positioned within the confines of the main frame 12 such that an axis 71 of the roll of web material is parallel to the linear movement of the carrier frame 30 (as represented by double headed arrow 68) and in aligned registry with a tape application mechanism 72 of the web cutting and tape application apparatus 66.

Figure 3:
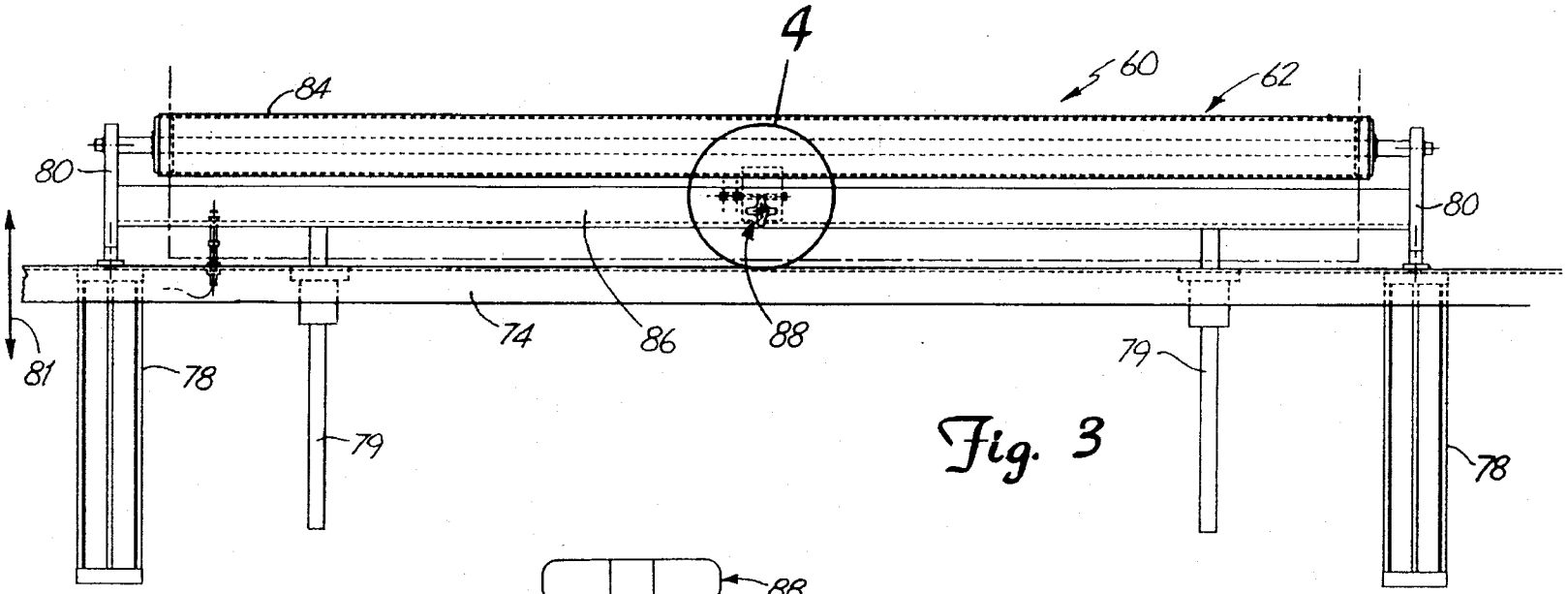
FIG. 3 is a top elevational view of the tension roller assembly of the web material tensioning apparatus shown in FIG. 2.
Figure 4:
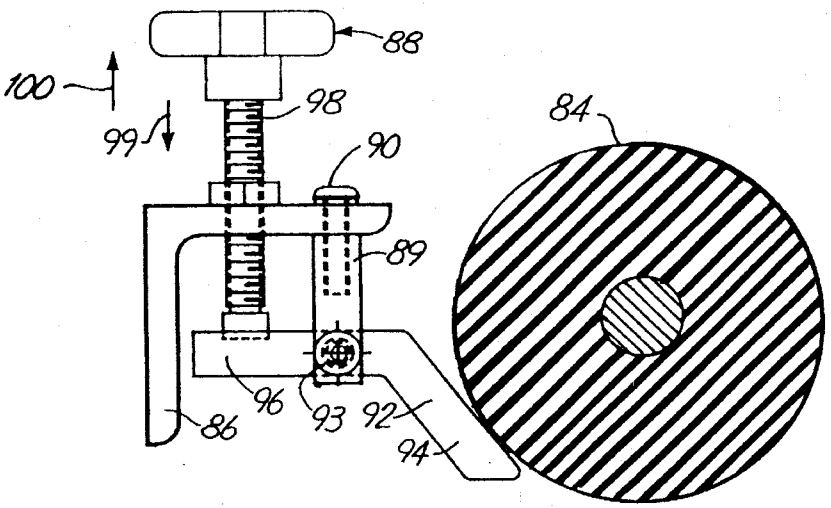
FIG. 4 is a greatly enlarged end elevational view partially in section of a tensioning device circled in FIG. 3.

As seen best in FIGS. 2–4, the tension roller assembly 62 includes a channel member 74 supported for pivotable movement relative to end support members 36 of the carrier frame 30 via pivot pins 76. Mounted on the channel member 74 are a pair of spaced linear drive elements, such as pneumatic drive cylinders 78, having linearly movable drive pistons 80. The drive cylinders 78 aligned by dual guide shafts 79 are configured to move the drive pistons in unison in opposite directions as represented by double headed arrow 81 in FIG. 3. The drive cylinders 78 are coupled to a pneumatic pressure mechanism 82 on the pneumatic control panel 147 (see FIG. 7). The microprocessor 58 controls the operation of the drive cylinders 78.

Coupled between ends of the drive pistons 80 is a rotatable idler roller 84. Upon operation of the drive cylinders 78, the idler roller 84 is linearly moved relative to the channel member 74. Further coupled between the drive pistons 80 is a rigid support bracket 86 that supports an idler roller tensioner 88 (sec FIG. 4). The idler roller tensioner 88 includes a support member 89 mounted to the support bracket 86 via suitable fasteners 90. A lever arm 92 is pivotably mounted to the support member 89 via pivot pins 93. A first end 94 of the lever arm 92 is adapted to engage the idler roller 84 while a second end 96 of the lever arm 92 is engaged by a threaded rotatable screw element 98 mounted on the support bracket 86. Tightening of the screw element 98 in the direction of arrow 99 pivots the lever arm 92 in a first direction which applies pressure against the idler roller 84 thereby restricting to some degree the free rotation of the idler roller 84. Loosening of the screw element 98 in the direction of arrow 100 pivots the lever arm 92 in a second direction opposite to the first direction which reduces the pressure against the idler roller 84 thereby increasing to some degree the free rotation of the idler roller 84.

As seen best in FIGS. 6–9, the tension roller assembly 62 further includes tension springs 102 mounted on the end support members 36 of the carrier frame 30 via support pins 103. A first end 104 of each tension spring 102 bears against a bearing pin 105 on the end support member 36 while a second end 106 of each tension spring 102 bears against the channel member 74. The tension springs 102 act to bias the tension roller assembly to the position shown in FIGS. 2 and 6.

Figure 5:
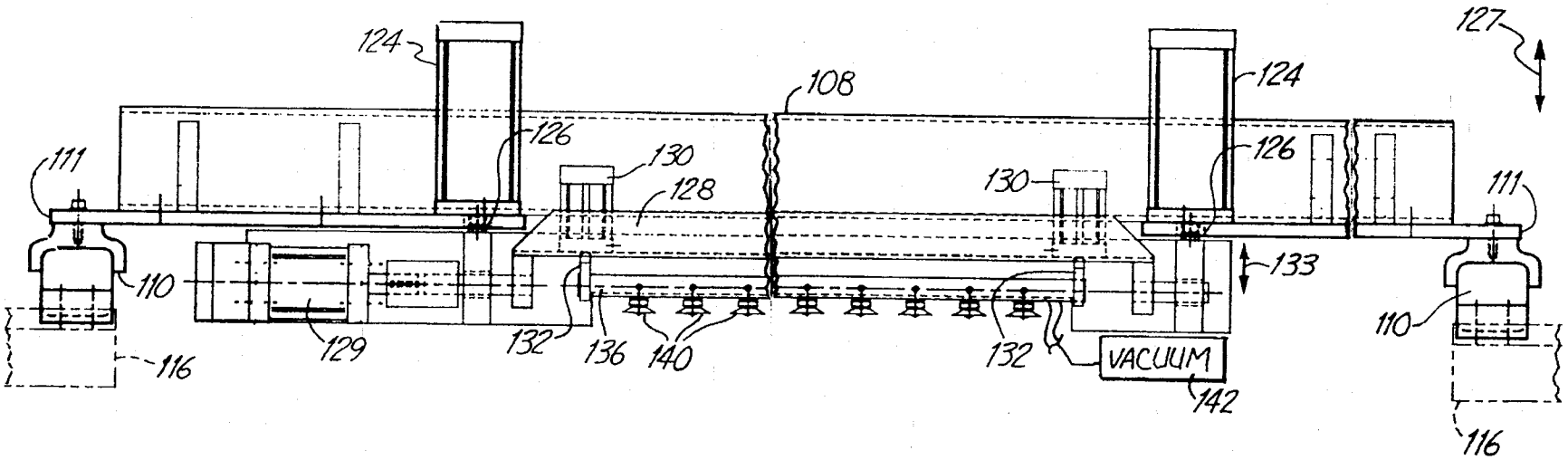
FIG. 5 is a front elevational view of the vacuum retraction assembly of the web material tensioning apparatus shown in FIG. 2.

As seen best in FIGS. 2 and 5, the vacuum retraction assembly 64 includes a main channel structure 108 mounted on a slide element 111. The main channel structure 108 is supported for linear movement (via slide elements 111 ) relative to and parallel to (as represented by double headed arrow 109 in FIG. 2) end support members 36 of the carrier frame 30. The slide elements 111, located one per side in FIG. 5, are internally connected as part of main pneumatic rodless cylinders 110 that are mounted at all angle with respect to the carrier frame 30, with a first end 112 of each main cylinder 110 mounted to an end support member 146 and a second end 114 of each main cylinder 110 mounted to a raised end support member 116 (FIG. 2).

Figure 6:
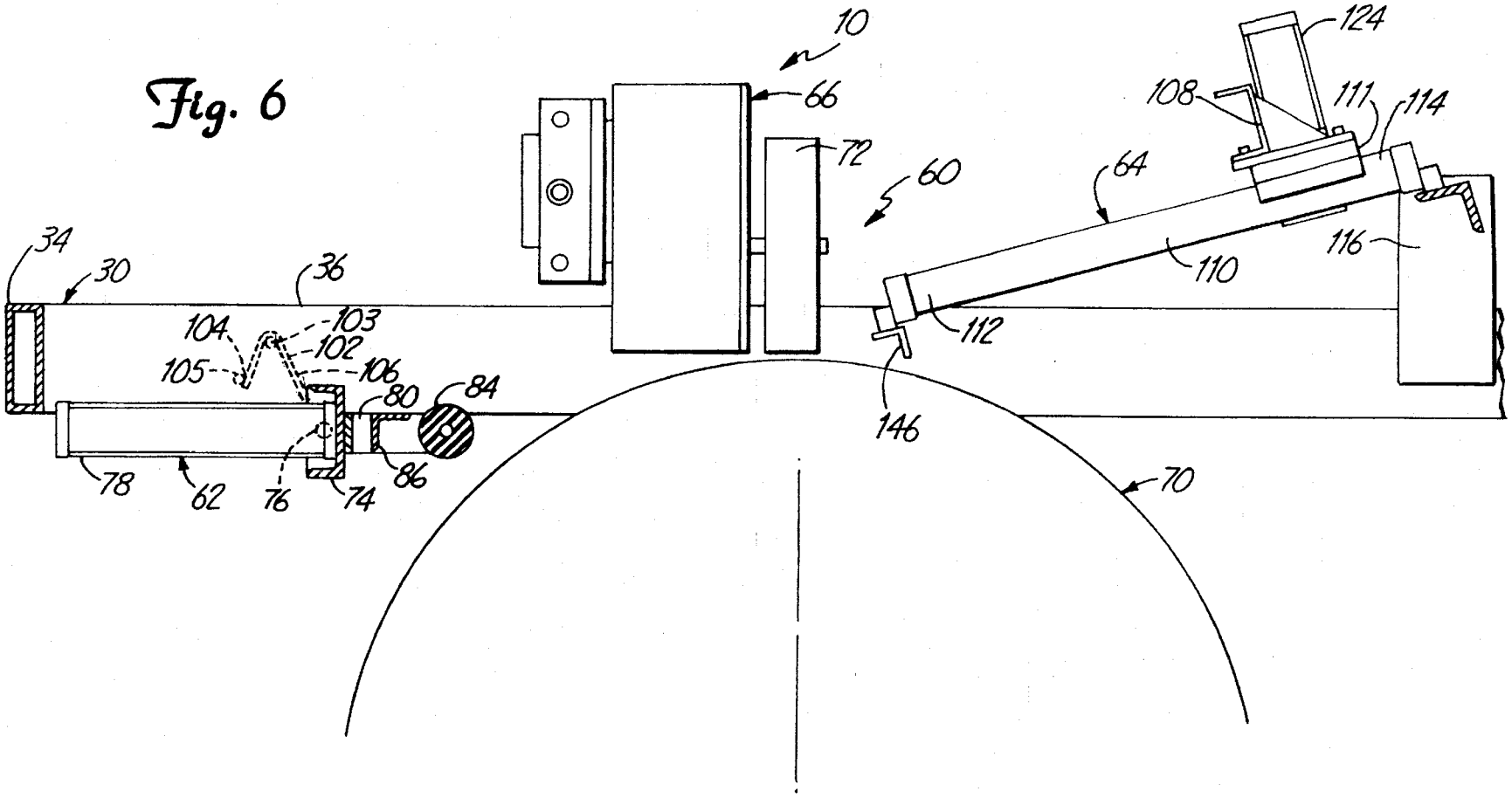
FIGS. 6–9 are end elevational views illustrating the operation of the web material tensioning apparatus shown in FIG. 2.
Figure 7:
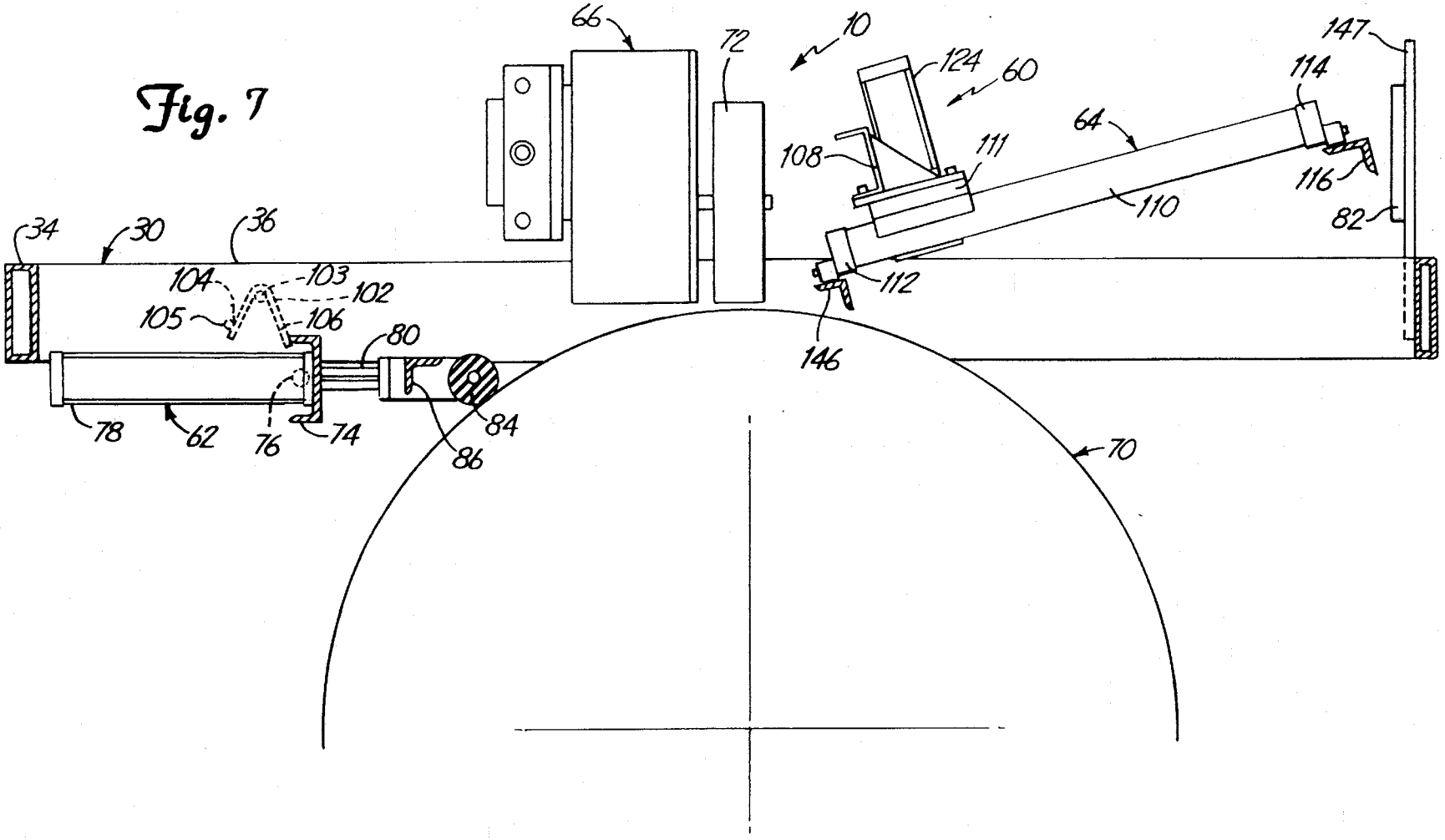

The main rodless cylinders 110 are configured to move the slide elements 111 in unison in opposite directions (as represented by double headed arrow 109 in FIG. 2) and to linearly move the channel structure 108 as best shown between FIGS. 6 and 7. The main rodless cylinders 110 are coupled to the pneumatic pressure mechanism 82 on the pneumatic control panel 147. The microprocessor 58 controls the operation of the main rodless cylinders 110.

Mounted on the main channel member 108 are a pair of spaced linear drive elements, such as secondary pneumatic drive cylinders 124, having linearly movable drive pistons 126. The secondary drive cylinders 124 are configured to move the drive pistons 126 in unison in opposite directions as represented by double headed arrow 127 in FIG. 5. The secondary drive cylinders 124 are coupled to the pneumatic pressure mechanism 82 mounted on the pneumatic control panel 147. The microprocessor 58 controls the operation of the secondary drive cylinders 124.

Coupled between ends of the drive pistons 126 is a rotatable secondary channel element 128. Upon operation of the secondary drive cylinders 124, the secondary channel element 128 is linearly moved relative to the main channel structure 108. The secondary channel element 128 is rotatable relative to the drive pistons 126 via pneumatic rotary actuation device 129 supported by the drive pistons 126. Mounted on the secondary channel element 128 are a pair of spaced linear drive elements, such as tertiary pneumatic drive cylinders 130, having linearly movable drive pistons 132. The tertiary drive cylinders 130 are configured to move the drive pistons 132 in unison in opposite directions as represented by double headed arrow 133 in FIG. 5. The tertiary drive cylinders 130 are coupled to the pneumatic pressure mechanism 82 mounted on the pneumatic control panel 147 (see FIG. 7). The microprocessor 58 controls the operation of the tertiary drive cylinders 130.

Coupled between ends of the drive pistons 132 is a vacuum bar 136 that is rotatable with the secondary channel element 128. Upon operation of the tertiary drive cylinders 130, the vacuum bar 136 is linearly moved relative to the secondary channel element 128 in the direction of double headed arrow 133. The vacuum bar 136 includes a plurality of spaced vacuum cups 140 which are coupled to a vacuum source 142 via a vacuum channel 144 in the vacuum bar 136 (see FIG. 8).

In operation, with the roll of web material positioned within the confines of the main frame 12 with the axis 71 of the roll of web material parallel to the linear movement of the carrier frame 30 (as represented by double headed arrow 68) and in aligned registry with a tape application mechanism 72 of the web cutting and tape application apparatus 66, the carrier frame 30 is lowered via operation of the drive motor 42 so as to position the web material tensioning apparatus 60 and the web cutting and tape application apparatus 66 immediately adjacent the web material of the roll of web material 70 (see FIG. 6). As seen in FIG. 7, the drive cylinders 78 of the tension roller assembly 62 are then actuated to extend the drive pistons 80 such that the idler roller 84 engages the web material of the roll of web material 70. Meanwhile the main rodless cylinders 110 are actuated moving the slide elements 111 and the vacuum retraction channel structure 108 down to the lower travel limit at the first ends 112 of the main rodless cylinders 110 (see FIG. 7).

Figure 8:
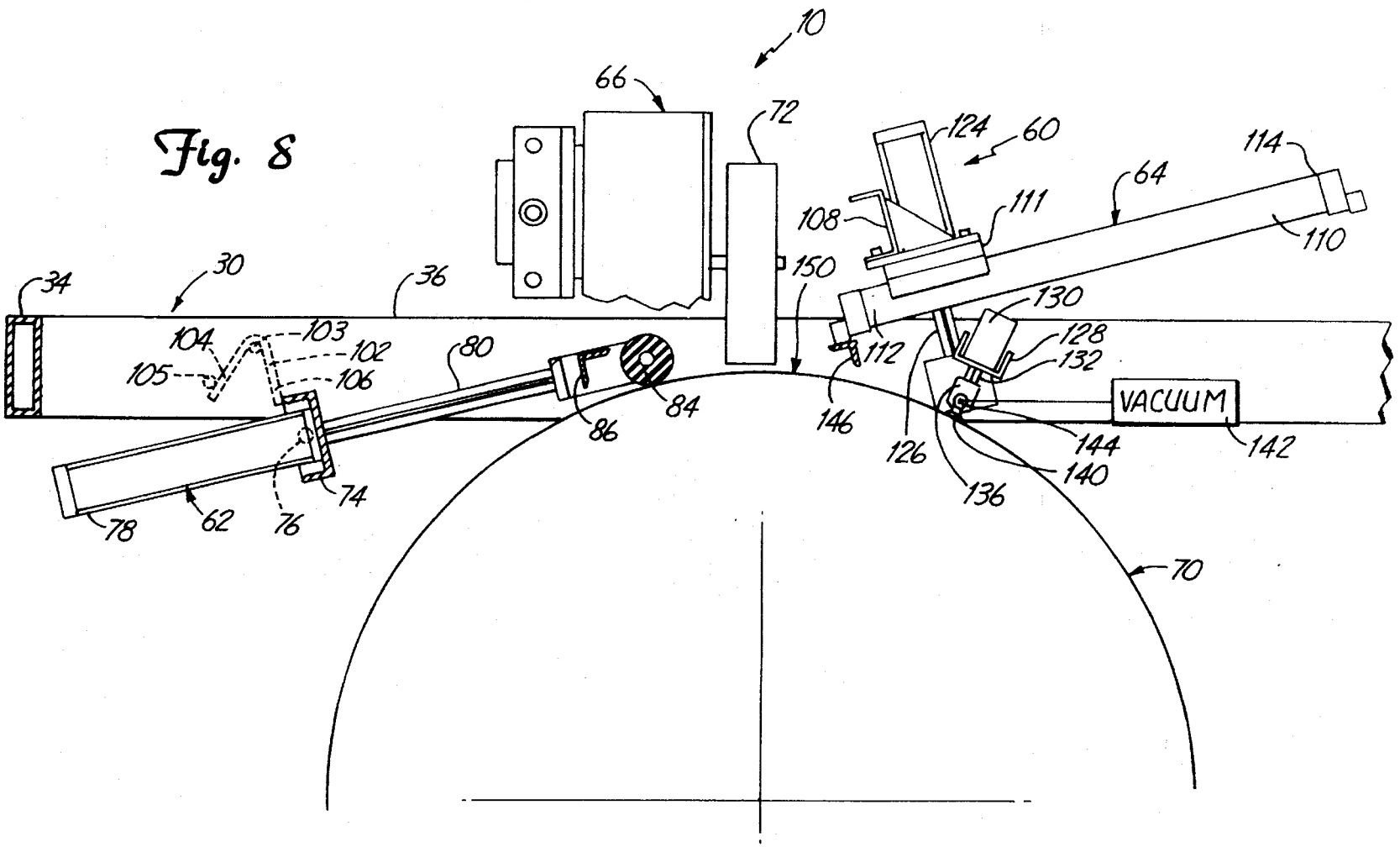

As seen in FIG. 8, continued extension of the drive pistons 80 causes the channel member 74 to pivot about pivot pins 76 against the bias of the tension springs 102 as the idler roller travels across the web material of the roll of web material 70. Full extension of the drive pistons 80 is illustrated in FIG. 8. Idler roller drag induced by the tensioner 88 acting on the idler roller 84 coupled with the spring bias of the tension springs 102 causes the outer layer of web material to be tensioned across the roll of web material 70. As the drive pistons 80 are fully extended, the secondary drive cylinders are actuated extending the drive pistons 126 and therewith the secondary channel element 128 and the vacuum bar 136. Once the drive pistons 126 are fully extended (see FIG. 8), the vacuum source 142 is activated and then the rotary actuation device 129 is actuated rotating the vacuum bar 136 to the position shown in FIG. 8 with the vacuum cups 140 extending generally perpendicular to a tangent of the roll of web material 70. Next, the tertiary drive cylinders 130 are actuated extending the drive pistons 132 such that the vacuum cups 140 contact the outer layer of web material of the roll of web material 70. The vacuum pressure through the vacuum cups 140 causes the outer layer of web material 150 to adhere to the vacuum bar 136.

Figure 9:
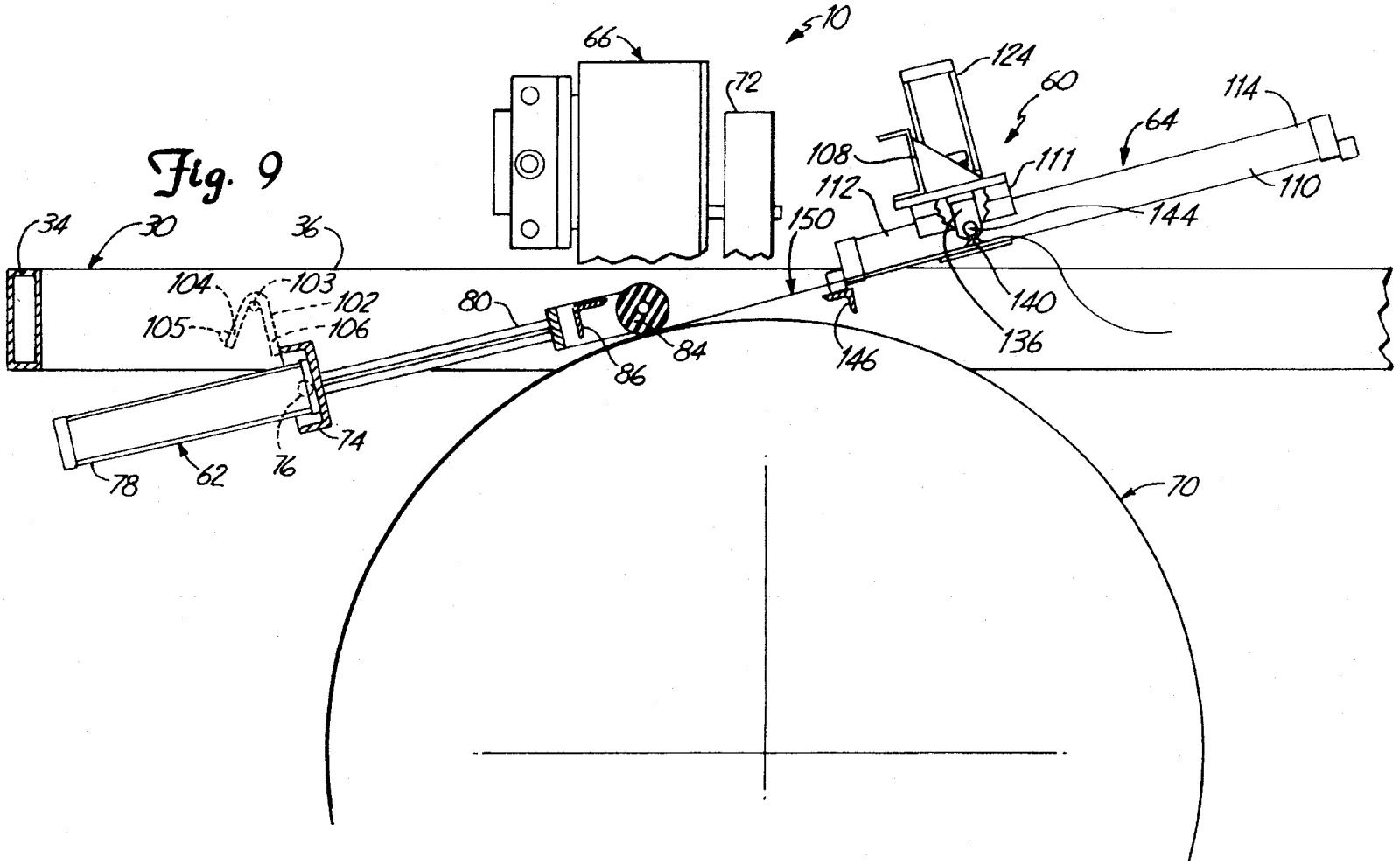

Next, as seen in FIG. 9, the drive pistons 132 are retracted, the secondary channel element 128 is rotated back and the drive pistons 126 are retracted to return all the vacuum bar 136 back to its home position. Then, the slide elements 111 are partially retracted to move the main channel structure 108 back along the main rodless cylinders 110 acting to further tension the outer layer 150 of the roll of web material 70. With the outer layer 150 of the roll of web material 70 fully tensioned the web cutting and tape application apparatus is actuated to form a cut leading edge of web material. Subsequent to the web cutting and tape application, the drive pistons 122 and 78 are fully retracted and the drive motor 42 is reversed, thereby returning all elements to their home position illustrated in FIG. 6.

The inventive web tensioning apparatus 10 disclosed herein provides an automated means for tensioning an outer layer 150 of a roll of web material 70 to substantially eliminate web material slack and wrinkles to permit the accurate formation of a cut leading edge of web material of desired shape and consistency from one cut to the next. This allows splicing tape to be applied to the cut leading edge of web material quickly and with alignment accuracy.

Although the present invention has been described with reference to preferred embodiments, workers skilled in the art will recognize that changes may be made in from and detail without departing from the spirit and scope of the invention.

What is claimed is:

1. An apparatus for tensioning a length of web material of a roll of web material, comprising:

a main frame;

a carrier fra0me assembly mounted on the main frame and configured to be positioned adjacent to a stationary roll of web material; and means on the carrier frame for contacting an outer layer of web material of the roll of web material and for applying static tension to the outer layer of web material, the means for contacting and applying tension including:

a rotatable idler roller; and a linear actuator mounted on the carrier frame assembly, the linear actuator movable between an initial position wherein the idler roller is spaced from the outer layer of web material and an operative position wherein the idler roller contacts the outer layer of web material, wherein the linear actuator creates tension in the outer layer the roll of web material as it moves from the initial position to the operative position.

2. The tensioning apparatus of claim 1 wherein the linear actuator has a drive piston with the idler roller being rotatably mounted on the drive piston, the drive piston being alternately movable between the initial and operative positions upon actuation of the drive cylinder.

3. The tensioning apparatus of claim 1, and further including:

means for pivotably mounting the linear actuator to the carrier frame assembly such that upon actuation of the linear actuator from the initial position toward the operative position the idler roller travels along the curvature of the roll of web material.

4. The tensioning apparatus of claim 3, and further including:

means for biasing the idler roller in a radial direction directed toward a longitudinal axis of the roll of web material to aid in tensioning an outer layer of web material about the roll of web material.

5. The tensioning apparatus of claim 4 wherein the biasing means is a tension spring that acts between the carrier frame assembly and the drive mechanism.

6. The tensioning apparatus of claim 1, and further including:

tensioning means associated with the idler roller for adjusting the rotational drag on the idler roller to control the amount of tension that the idler roller applies to an outer layer of web material.

7. The tensioning apparatus of claim 6 wherein the tensioning means includes:

a pivotable lever arm mounted on the drive mechanism and adjacent to the idler roller, the lever arm having a first end in contact with the idler roller and an opposite second end; and an adjustment element in contact with the second end of the lever arm, the adjustment element being movable in a first direction to increase the rotational drag on the idler roller and in a second direction, opposite to the first direction, to decrease the rotational drag on the idler roller.

8. An apparatus for tensioning a length of web material of a roll of web material, comprising:

a main frame;

a carrier frame assembly mounted on the main frame and configured to be positioned adjacent to a stationary roll of web material;

means on the carrier frame for contacting and outer layer of web material of the roll of web material and for applying static tension to the outer layer of web material, the means for contacting and applying tension including a tension roller assembly;

a vacuum source;

a vacuum bar having a plurality of vacuum cups coupled to a vacuum source; and drive means coupled to the vacuum bar for moving the vacuum bar into and out of contact with the roll of web material such that actuation of the vacuum source causes the outer layer of web material to adhere to the vacuum bar while subsequent actuation of the drive means to move the vacuum bar out of engagement with the roll of web material acts to tension the outer layer of web material about the roll of web material.

9. The tensioning apparatus of claim 8 wherein the drive means includes:

a support element for rotatably supporting the vacuum bar: and a drive element for rotating the vacuum bar relative to the support element.

10. The tensioning apparatus of claim 8 wherein the tension roller assembly includes:

a rotatable idler roller; and a drive mechanism mounted on the carrier frame assembly, the drive mechanism moving the idler roller alternately between a first position wherein the idler roller is spaced from the outer layer of web material and a second position wherein the idler roller contacts the outer layer of web material and acts to tension the outer layer about the roll of web material.

11. The tensioning apparatus of claim 10 wherein the drive mechanism includes a pneumatic drive cylinder having a drive piston with the idler roller being rotatably mounted on the drive piston, the drive piston being alternately movable between the first and second positions upon actuation of the drive cylinder.

12. The tensioning apparatus of claim 10, and further including;

means for pivotably mounting the drive mechanism to the carrier frame assembly such that upon actuation of the drive mechanism from the first position toward the second position the idler roller travels along the curvature of the roll of web material.

13. The tensioning apparatus of claim 10, and further including:

tensioning means associated with the idler roller for adjusting the rotational drag on the idler roller to control the amount of tension that the idler roller applies to an outer layer of web material.

14. An apparatus for tensioning a length of web material of a roll of web material, comprising:

a main frame;

a carrier frame assembly mounted on the main frame and configured to be positioned adjacent to a roll of web material, the carrier frame assembly including:

a vacuum retraction assembly for contacting an outer layer of web material of the roll of web material and for applying tension to the outer layer of web material, the vacuum retraction assembly including:

a vacuum source;

a vacuum bar having a plurality of vacuum cups coupled to a vacuum source; and drive mean coupled to the vacuum bar for moving the vacuum bar into and out of contact with the roll of web material such that actuation of the vacuum source causes the outer layer of web material to adhere to the vacuum bar while subsequent actuation of the drive means to move the vacuum bar out of engagement with the roll of web material acts to tension the outer layer of web material about the roll of web material wherein the drive means includes:

a support element for rotatably supporting the vacuum bar;

a drive element for rotating the vacuum bar relative to the support element; and a linear drive mechanism mounted to the support element for driving the vacuum bar linearly with respect to the support element.

15. The tensioning apparatus of claim 14 wherein the drive means further includes:

a support member; and a linear drive device mounted on the support member and coupled to the support element for driving the support element linearly with respect to the support member.

16. The tensioning apparatus of claim 15 wherein the drive means further includes:

an end support bracket assembly mounted on the carrier frame assembly; and a linear drive assembly including rodless slide cylinders mounted at an angle with respect to the carrier frame assembly and coupled to the support member for driving the support member linearly relative to the carrier frame assembly.

17. An apparatus for tensioning a length of web material of a roll of web material, comprising:

a main frame;

a carrier frame assembly mounted on the main frame and configured to be positioned adjacent a stationary roll of web material; and a linear actuator mounted on the carrier frame assembly, the linear actuator extendable between a first position wherein an idler roller is spaced from the roll of web material, a second position wherein the idler roller contacts the roll of web material, and a third position wherein the idler roller moves along a circumference of the roll of web material, the linear actuator creating tension in the roll of web material as it moves from the second position to the third position.

* * * * *

UNITED STATES PATENT AND TRADEMARK OFFICE

CERTIFICATE OF CORRECTION

PATENT NO. : 5,524,844

DATED : JUNE 11, 1996

INVENTOR(S) : MICHAEL O. MCCORMICK, CHESTER W. MOORE, DANIEL R. HICKS, GOWER W. KOEBLER

It is certified that error appears in the above-indentified patent and that said Letters Patent is hereby corrected as shown below:

Col. 1, line 17, delete "or", insert --of--

Col. 1, line 18, delete "or", insert --of--

Col. 1, line 19, delete "or", insert --of--

Col. 1, line 21, delete "of", insert --or--

Col. 4, line 28, delete "tier", insert --for--

Col. 4, line 43, after "20", insert --,--

Signed and Sealed this

Fifth Day of November, 1996

*Attest:*

*Attesting Officer*

BRUCE LEHMAN

*Commissioner of Patents and Trademarks*